United States Patent [19]

Strobel

[11] 4,240,480

[45] Dec. 23, 1980

[54] MULTIPLE USE BAG WITH DUAL PURPOSE STRAPS

[76] Inventor: Lucille C. Strobel, 8305 Sprague Pl., New Carrollton, Md. 20784

[21] Appl. No.: 52,260

[22] Filed: Jun. 26, 1979

[51] Int. Cl.[3] ..... B65D 33/06; B65D 33/14; B65D 33/16

[52] U.S. Cl. ..... 150/3; 150/1.7; 150/12

[58] Field of Search ..... 224/31, 46 R, 47, 58, 224/55, 202, 209, 258; 150/33.3, 12, 3, 1.7, 33.12

[56] References Cited

U.S. PATENT DOCUMENTS

| | | | |
|---|---|---|---|
| 874,817 | 12/1907 | York | 224/47 |
| 909,248 | 1/1909 | Stager | 150/1.7 |
| 1,308,028 | 7/1919 | Banning | 150/33 X |
| 1,370,636 | 3/1921 | Dwyer | 224/46 R X |
| 2,053,464 | 9/1936 | Dalsheim | 150/33 X |
| 2,131,382 | 9/1938 | Lobel | 150/33 |
| 2,707,035 | 4/1955 | Lashley | 150/33 X |
| 3,143,748 | 8/1964 | Manning | 150/12 X |
| 3,826,296 | 7/1974 | Morris | 150/3 |
| 3,976,113 | 8/1976 | Kim | 150/12 |

FOREIGN PATENT DOCUMENTS

| | | | |
|---|---|---|---|
| 738091 | 12/1932 | France | 150/33 |
| 1361421 | 4/1964 | France | 150/33 |
| 1510120 | 1/1968 | France | 150/33 |

*Primary Examiner*—Allan N. Shoap
*Attorney, Agent, or Firm*—Staas and Halsey

[57] ABSTRACT

A multiple use bag having dual purpose straps affixed thereto comprises a fairly large capacity main body structure of elliptical configuration enclosed at one end and open at the other end, structure provided adjacent the opening for closing of the bag in a secure manner, an outside pocket of approximately two-thirds the size of one outer side of the bag provides a pocket for holding additional items, a pair of straps affixed adjacent the bag opening opposite the pocket structure, the straps being relatively long and provided with the snap structures at at least the extreme opposite end and approximately midway of each strap, complementary snap structures being applied on the side of the bag of the pocket near the upper opening and also along the pocket and inside thereof. The snap structures permit the bag to be carried by crossed straps in tote bag fashion, and also permit the straps to be shortened and hung over horizontal rails, backs or arms of chairs, chaise lounges and the like. In the hanging configuration, the straps also provide convenient storage between the snap structure of each strap as secured to the bag for holding packages of cigarettes, an umbrella, box of kleenex tissues, or similar articles.

12 Claims, 6 Drawing Figures

MULTIPLE USE BAG WITH DUAL PURPOSE STRAPS

BACKGROUND OF THE INVENTION

1. Field of the Invention

This invention relates generally to bags which may be used for a number of different uses and which are provided with straps which perform at least two functions.

2. Description of the Prior Art

A common problem with known type bags is that they can generally be only used for one primary purpose. That is, they generally are not arranged or designed so that they can serve a multiple number of uses or purposes. Thereby, a number of individual bags must normally be obtained to serve the many uses for which people desire such bags.

Another common problem of known type bags is that they are not designed so that the carrying handles or straps can be used for other purposes than just carrying the bag.

Existing prior patents which may be pertinent to this invention are as follows:

| INVENTOR | PATENT NUMBER | DATE GRANTED |
|---|---|---|
| Dwyer | 1,468,711 | September 25, 1923 |
| Bailey | 1,524,077 | January 27, 1925 |
| Gomi | 1,883,702 | October 18, 1932 |
| Oechsle | 3,346,155 | October 10, 1967 |
| Sewitch | 3,565,277 | February 23, 1971 |
| Alley | 3,786,972 | January 22, 1974 |

SUMMARY OF THE INVENTION

An object of the present invention is to provide a relatively large size bag having a pair of straps which may be fastened at one end in at least two different relative positions to the bag for use in a dual function manner.

Another object of this invention is to provide a bag having a pair of straps which may be used in a short or mid-length manner for attaching the bag to a horizontal member such as an arm of a chair or the like, and also the straps may be crossed and attached so as to form a handle of a tote bag which is easily carried.

A further object of this invention is to provide a bag of multiple functions having dual purpose straps associated therewith which also may support and hold additional items between attachment portions of the straps and the bag.

A still further object of this invention is to provide a bag having opening closure structure and an additional outside pocket structure with closure structure associated therewith for multiple use functions.

One of the important features of the bag of subject invention is that it can be used for many different purposes and uses, and is provided with a pair of straps attached along one side near the mouth of the bag and removably and adjustably attached along the opposite side of the bag by female snap structure at the extreme ends of each strap and also approximately midway of each strap. Appropriate male snap structures are provided on the bag for association with the female snap structures and to provide at least two alternative attachment points for each strap. Thus, the straps may be crossed and applied to the male snap structures with the straps being longer in length for use of the bag as a tote bag.

Another position of the straps is with the straps being shortened in loop length and having both of the female snap members of each strap attached to other complementary male snap members on the bag. So attached, each strap provides a convenient structure for holding additional items such as cigarettes, kleenex tissues, umbrellas, and the like. Also another important feature of this invention is that when the bag is used in this configuration, the lower or free ends of the strap ends are snapped to the male members within an outer pocket provided on the outside surface of the bag. Thus, the ends are prevented from accidental engagement by someone passing thereby which could inadvertently unsnap same and defeat the holding ability thereof. This protective feature is quite simple, but yet very, very important to subject invention.

Both the bag opening and also the pocket opening are provided with appropriate closure structure so that contents contained within the bag and within the pocket may be secured therewithin against accidental loss or dumping.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
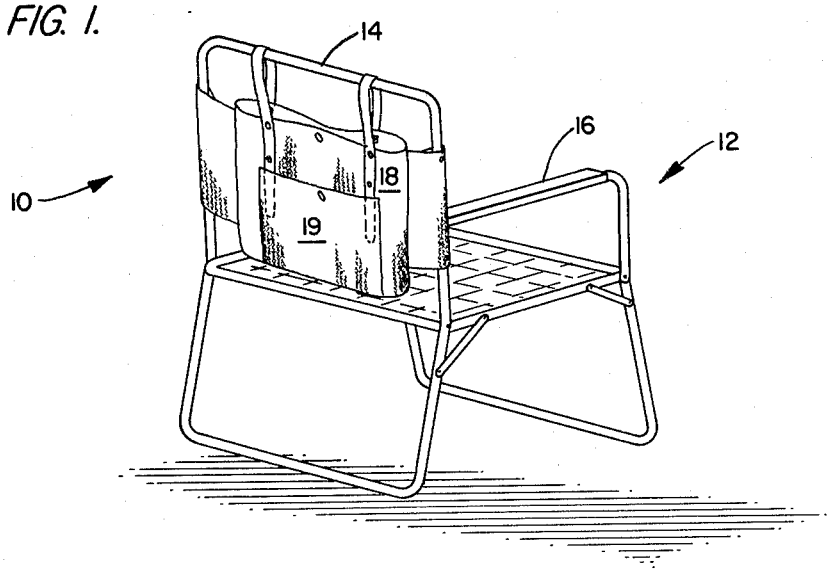
FIG. 1 is a perspective view of the bag of this invention in the shortened strap manner of use.

Referring to FIG. 1 of the drawing, reference numeral 10 indicates in general the bag of this invention as in use with a beach chair. The beach chair 12 being of conventional aluminum and plastic web construction, of foldable construction, and having an upper back rail 14 and arm rests 16.

In one configuration of the bag strap structure, the bag may be suspended from the relatively horizontal back rail 14 as shown or an arm rest 16.

Figure 2:
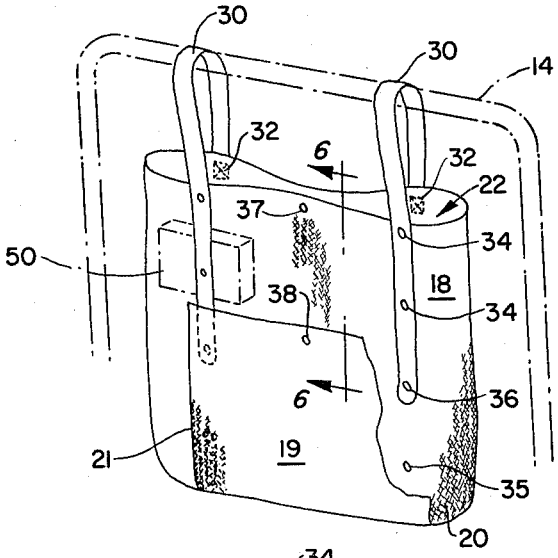
FIG. 2 is a slightly enlarged perspective of the bag structure with dual purpose straps.

In FIG. 2, the shortened loop strap arrangement is shown in greater detail. The bag consists of a main body member 18 closed at one end and open at the other end. Along one side of the open end a pair of straps 30 are attached by sewing 32. The opening 22 is also provided with a female snap 37 and a male snap 35 for the purpose of securing the opening.

Figure 3:
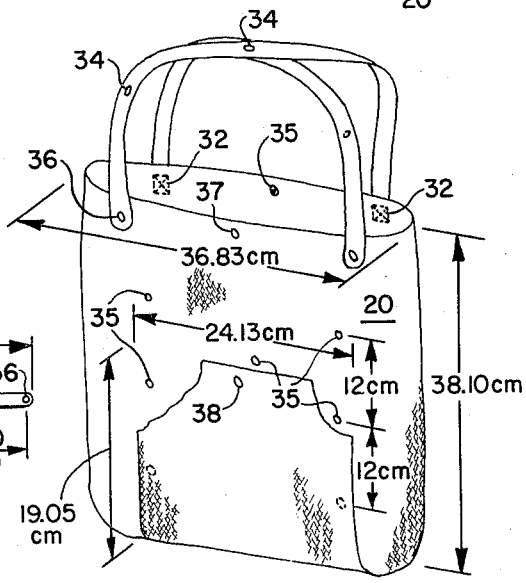
FIG. 3 is a perspective view of the bag per se with the straps crossed for the strap handle carrying configuration.
Figure 4:
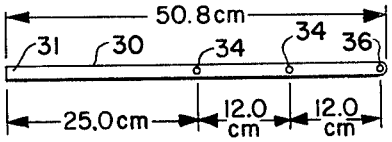
FIG. 4 is a plan view of an individual bag strap per se.
Figure 5:
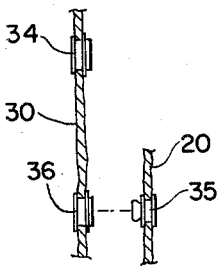
FIG. 5 is a partial cross-sectional view of the plural snap fastener construction.

As best seen in FIG. 4, each individual strap 30 has an end 31 which is attached to the bag in a permanent manner, such as by sewing 32 shown in FIG. 2, and at the extreme opposite end a female snap structure 36. Approximately midway between the two ends of each strap another female snap structure 34 is provided, and then another female snap structure 34 between these two. Thus, by means of the complementary male snap structures 35 which are appropriately positioned as shown in FIGS. 2 and 3 on the bag, each strap can be snapped into the shortened loop configuration as shown in FIG. 2 or alternatively a middle loop position, not shown. In the configuration shown with both snap structures 34, 35 and 36, 35 in snap engagement, the strap portion between the engaged snaps provide convenient holding structure for cigarettes 50, or an umbrella, kleenex tissues, and similar items (not shown).

Another important feature of the bag is in the pocket 19 which is appropriately attached to the outer surface of the bag by sewing or the like. A closure snap 38, 35 also is provided along the opening of the pocket to secure same and prevent articles contained therewithin from spilling or falling out. The free ends of the respective straps 30, when snapped in the configuration of FIG. 2, are mounted within or inside of the pocket 19 so as to protect the ends from inadvertent or accidental unsnapping. Thus, if a person is using a beach chair 12 at the ocean and has the bag suspended over the rear rail 14 as shown in FIG. 1, and someone passes closely behind and brushes against the straps and the bag, the straps will be protected from accidental unsnapping.

This feature is quite simple, but yet very, very important to subject invention. Especially when the portion of the straps and the opposite side of the bag are being used to hold articles such as 50 therebetween, the inadvertent or accidental unsnapping of the lower end could be disastrous with the articles falling into the sand and certainly contaminating, if not actually ruining same.

Looking at FIG. 3, the use of the bag in tote bag fashion is shown. The respective straps 30 are crossed as shown and the snaps 36 at the extreme free ends of the respective straps are fastened or snapped to the male snap members 35 which are along the upper opening 22 of the bag. In this configuration, the straps function as a strong support handle, and by being crossed, provide an easily gripped and positive support for the bag, which may be quite heavy from numerous articles contained therewithin.

While only two positions of the snap structures are shown, a plurality of snaps with various spacings are provided on the side of the main body member 18 of the bag to permit even greater variations of the strap lengths. Alternatively, the male snap structures may be provided on the straps, and the female snap structures mounted on the bag, though the preferred embodiment is as previously described.

Preferably the bag is constructed of waterproof nylon with the straps being either of nylon or relatively heavy cotton webbing. Heavy duty snap fasteners are also envisioned for use with the bag.

However, instead of waterproof nylon, all plastic material may be used, or fabric impregnated with plastic may be used. In such construction, instead of the straps and pocket being attached to the main body by sewing, heat sealing attachment of the plastic material may be used. Such plastic with heat sealing attachment can decrease the cost and increase the speed of production of such bags and make same readily available to the multitudes. However, preferably the waterproof nylon and sewing construction will be used, even though slightly more costly, because it provides a more durable and strong bag.

Figure 6:
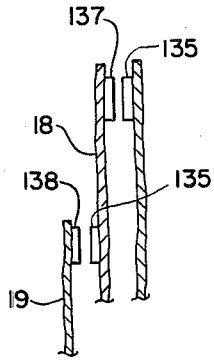
FIG. 6 is an alternative bag closure embodiment.

FIG. 6 shows a modified embodiment, wherein snaps 37, 35 and 38, 35 are replaced by strips of synthetic materials which adhere when pressed together sold under the trademark Velcro, 137, 135, and 138, 135 for use as the bag and pocket closing retention structure.

The preferred dimensions for the bag are 38.10 cm high by 36.83 wide, the pocket 19.05 cm high by 24.13 cm wide, and each strap is about 50.8 cm long. The snaps on each strap are spaced approximately 25, 12 and 12 cm from the end without any snap structure. The snap structures on the bag are spaced approximately 12 cm apart as shown in FIG. 3.

The fact that the bag of subject invention can be used in a multitude of different manners, as well as the straps of dual purpose function, provide a readily and easily useable structure of great utility to the everyday person.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

I claim:

1. A multiple purpose bag having dual use suspension structure associated therewith comprising:

a main body member closed at one end and open at the other end;

a pair of straps with one end of each strap non-removably attached along one side of the body member adjacent said open end and with the other end of each strap being detachably connected by fastening means at said other end of each strap;

complementary fastening means associated with the opposite side from said one side of said main body member for detachably securing the fastening means of the detachable ends of the individual straps to the body member in at least two different positions to provide at least two strap configurations; and further means consisting of a pocket with an opening in the same direction as the open end of the main body member provided on the body member so that when the detachable ends of said straps are secured to the body member in at least one position thereof by said complementary fastening means, the detachable ends of said straps are covered by said further means and thereby protected from inadvertent detachment from the body member.

2. The structure of claim 1, wherein said fastening means includes at least two snap structures attached to each of the individual straps on the detachable ends thereof, and said complementary fastening means includes a plurality of complementary snap structures attached to the body member so as to permit the ends of each strap to be snapped to the bag in a choice of the at least two different positions, and at least two of said complementary snap structures being associated with said further means for protecting the strap ends.

3. The structure set forth in claim 2, wherein said pocket attached to the bag main body member is also usable for storage of additional articles therewithin, and said pocket being provided with closure means along said opening for the pocket.

4. The structure set forth in claim 1, wherein one of said at least two positions of said snap structure for the individual straps permit the crossing of the pair of straps and attachment of one end of each strap to an upper snap structure near the bag opening for providing a bag carrying handle of crossed configuration.

5. The structure of claim 1, wherein one of said at least two positions of said snap structure for the individual straps provides a relatively short loop portion for each strap so that same may be suspended from a substantially horizontal member for support of the bag in an easily, readily useable position.

6. The structure as in claim 3, wherein the open end of the bag main body is provided with closure means to secure contents therewithin against inadvertent spilling.

7. The structure as in claim 6, wherein said closure means for both the pocket and the open end of the bag consist of additional pairs of snap structures.

8. The structure as in claim 6, wherein said closure means for both the pocket and the open end of the bag consist of strips of material which readily interlock with each other.

9. The structure as set forth in claim 2, wherein the open end of the bag main body member is provided with closure means to secure contents therewithin against inadvertent spilling.

10. The structure of claim 2, wherein three snaps are provided for the detachable end of each of said straps, a first one of said three snaps being near the very end of the strap, a second one of the three snaps being midway of the strap, and the third snap being approximately midway between the first and second snaps.

11. The structure as in claim 10, wherein said plurality of complementary snap structures attached to the body member comprise at least three complementary snap portions arranged in opposing pairs along said body member for providing the multiple snapping positions and furthermore for providing strap holding portions for holding small articles between adjacent snaps when at least two adjacent snaps are secured.

12. A multiple purpose bag having dual use suspension structure associated therewith comprising:

a main body member closed at one end and open at the other end;

a pair of straps with one end of each non-removably attached along one side of the body member adjacent said open end and with the other end of each strap being detachably connected by fastening means at said other end of each strap;

complementary fastening means associated with the opposite side from said one side of said main body member for detachably securing the fastening means of the detachable ends of the individual straps to the body member in at least two different positions to provide at least two strap configurations, said fastening means including at least two snap structures attached to each of the individual straps on the detachable ends thereof, and said complementary fastening means including a plurality of complementary snap structures attached to the body member so as to permit the ends of each strap to be snapped to the bag in a choice of the at least two different positions;

one of said at least two positions of said snap structure for the individual straps providing a relatively short loop portion for each strap so that same may be suspended from a substantially horizontal member for support of the bag in an easily, readily usable position;

an outer pocket being attached to the bag main body member for storage of additional articles therewithin, said pocket being provided with closure means along an opening for the pocket and the lowermost snap structures for the individual straps being concealed within the said pocket structure so as to prevent inadvertent unsnapping of the extreme ends of the straps when attached to these snap structures.

* * * * *